US007864973B2

(12) United States Patent
Oliveira et al.

(10) Patent No.: US 7,864,973 B2
(45) Date of Patent: Jan. 4, 2011

(54) USER DISPOSABLE SLEEVE FOR USE WITHIN THE EAR CANAL

(75) Inventors: Robert J. Oliveira, Maplewood, MN (US); Michael T. Venem, Saint Paul, MN (US); Martin P. Babcock, White Bear Lake, MN (US)

(73) Assignee: Hearing Components, Inc., Oakdale, MN (US)

( * ) Notice: Subject to any disclaimer, the term of this patent is extended or adjusted under 35 U.S.C. 154(b) by 879 days.

(21) Appl. No.: 11/760,104

(22) Filed: Jun. 8, 2007

(65) Prior Publication Data

US 2007/0230731 A1 Oct. 4, 2007

Related U.S. Application Data

(63) Continuation of application No. 10/729,715, filed on Dec. 5, 2003, now Pat. No. 7,236,605.

(51) Int. Cl.
*H04R 25/00* (2006.01)
*H04R 25/02* (2006.01)

(52) U.S. Cl. ..... 381/328; 181/130

(58) Field of Classification Search ..... 381/23.1, 381/72, 322, 330, 382; 181/129, 130, 135; 2/209, 423

See application file for complete search history.

(56) References Cited

U.S. PATENT DOCUMENTS

| | | | | |
|---|---|---|---|---|
| 3,157,245 | A * | 11/1964 | Bernstein | 181/135 |
| 4,864,610 | A | 9/1989 | Stevens | |
| 4,880,076 | A | 11/1989 | Ahlberg et al. | |
| 5,002,151 | A | 3/1991 | Oliveira et al. | |
| 5,920,636 | A | 7/1999 | Oliveira et al. | |
| 6,310,961 | B1 | 10/2001 | Oliveira et al. | |
| 6,382,346 | B2 | 5/2002 | Brimhall et al. | |
| 2003/0051939 | A1 * | 3/2003 | Werblud | 181/135 |

FOREIGN PATENT DOCUMENTS

WO 99/07182 A2 2/1999

* cited by examiner

*Primary Examiner*—Brian Ensey
(74) *Attorney, Agent, or Firm*—Seager, Tufte & Wickhem, LLC

(57) ABSTRACT

User disposable sleeves for use with sound controlling structures having a non-constant radial profile can include an inner portion adapted to releasably attach to the sound controlling structure and an outer portion adapted to fit within a user's ear canal. The user disposable sleeve can include holding means configured to releasably secure the sleeve to the elongate sound controlling structure and fitment means configured to conform to an inner surface of an ear. The fitment means can be fixedly disposed over the holding means.

24 Claims, 7 Drawing Sheets

USER DISPOSABLE SLEEVE FOR USE WITHIN THE EAR CANAL

RELATED APPLICATIONS

This application is a continuation of U.S. application Ser. No. 10/729,715, filed Dec. 5, 2003, the entire disclosure of which is incorporated herein by reference.

TECHNICAL FIELD

The present invention relates generally to sound controlling devices and more specifically to user disposable sleeves configured to be releasably secured to sound controlling devices.

BACKGROUND

Several user disposable sleeves are known that have outer surfaces adapted to conform to the inner surface of an ear after a foam outer portion is compressed, inserted into the ear canal, and allowed to expand. These sleeves are adapted for releasable attachment to sound controlling devices or structures and are described, for example, in U.S. Pat. Nos. 4,880,076; 5,002,151; 5,920,636; and 6,310,961, the disclosures of which are incorporated herein by reference. These patents show user disposable sleeves that are adapted for releasable attachment to sound controlling devices or structures having truncated conical outer surfaces diverging in cross-sectional size from their distal ends and having abutment surfaces spaced predetermined distances from their distal ends.

While such sleeves, when engaged with the sound controlling structures, can provide suitable interfaces between the sound controlling structures and the inner surface of an ear in which the sleeves are positioned, those sleeves may either be more expensive to manufacture and/or more difficult to remove from the sound controlling structures than may be desired for some applications. A need remains for improved user disposable sleeves.

SUMMARY

The invention is directed to user disposable sleeves for use with sound controlling structures. The user disposable sleeves include an inner portion adapted to releasably attach to the sound controlling structure and an outer portion adapted to fit within a user's ear canal.

Accordingly, an example embodiment of the invention can be found in a user disposable sleeve that is adapted for use with an elongate sound controlling structure having an outer surface having a non-constant radial profile. The user disposable sleeve includes holding means configured to releasably secure the sleeve to the elongate sound controlling structure and fitment means configured to conform to an inner surface of an ear. The fitment means is fixedly disposed over the holding means and the holding means is configured to permit placement of the sleeve on the elongate sound controlling structure by axially sliding the sleeve onto the elongate sound controlling structure.

Another example embodiment of the invention can be found in a method of using an elongate sound controlling device having a non-constant radial profile. A disposable sleeve is provided, the sleeve including holding means to releasably secure the sleeve to the elongate controlling structure. Resiliently compressible foam configured to conform to an inner surface of a user's ear is secured to the holding means. The disposable sleeve is axially slid onto the elongate sound controlling device. The foam is compressed and the elongate sound controlling device is inserted into the user's ear canal, and the foam is then allowed to expand.

Another example embodiment of the invention can be found in a sound controlling structure that includes an elongate sound tube and a disposable sleeve disposed over the elongate sound tube. The disposable sleeve includes holding means configured to releasably secure the sleeve to the elongate sound controlling structure and fitment means configured to conform to an inner surface of an ear. The fitment means is secured to the holding means. The holding means is configured to permit placement of the sleeve on the elongate sound tube by axially sliding the sleeve onto the elongate sound controlling structure.

Another example embodiment of the invention can be found in a sleeve that includes an outer portion of resiliently compressible polymeric foam having an outer surface adapted to conform to the inner surface of an ear after the foam outer portion is compressed, inserted into the ear canal, and allowed to expand, said outer portion having opposite first and second ends, and an inner surface extending through the outer portion between said first and second ends. The sleeve also includes a tube of relatively stiff flexible material having an axis and opposite axially spaced first and second ends, an outer surface adhered to said inner surface of said outer portion, and an inner surface defining a through passageway, the outer and inner surfaces of said tube having cross sections of generally uniform shape and size along said axes. The tube has a continuous generally annular portion adjacent said first end, and a plurality of axially extending circumferentially spaced slits between the inner and outer surfaces of said tube extending from said annular portion to the second end of said tube and defining axially extending portions of said tube that can flex radially outwardly of the axis of the tube.

BRIEF DESCRIPTION OF THE DRAWINGS

The present invention will be further described with reference to the accompanying drawings wherein like reference numerals refer to like parts in the several views, and wherein.

DETAILED DESCRIPTION

Figure 1:
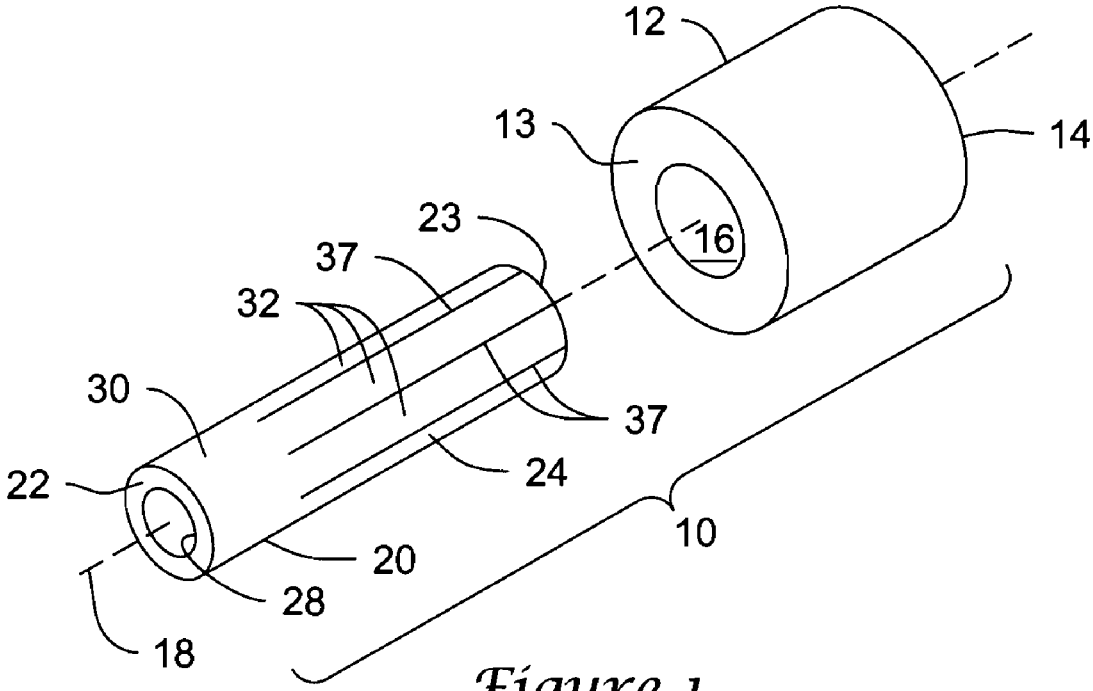
FIG. 1 is an exploded perspective view illustrating a foam outer portion and a tube in accordance with an embodiment of the invention.
Figure 2:
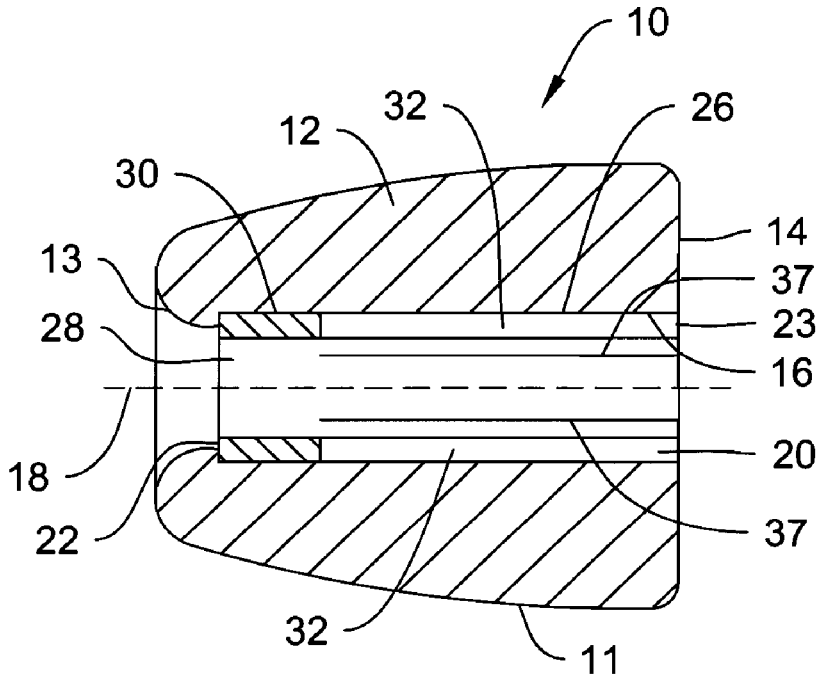
FIG. 2 is a longitudinal cross-sectional view of the sleeve of FIG. 1.

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

Referring now to FIGS. 1 through 4 of the drawing, there is illustrated a first embodiment of a sleeve 10. The sleeve 10 is useful on various types of sound controlling structures, including (but not limited to) sound controlling structures that house speakers and/or microphones adjacent their distal ends such as are used in some audio testing equipment, sound controlling structures with through passageways communicating with a hearing aid, or sound controlling structures used with devices that allow or facilitate communication in noisy environments.

As illustrated, the sleeve 10 includes an outer member 12 having an outer surface 11 that is adapted to conform to the inner surface of an ear after the outer member 12 has been compressed, inserted into the ear canal, and allowed to expand. In some embodiments, the outer member 12 can be formed of a resiliently compressible polymeric foam. The foam outer member 12 has a distal end 13 and a proximal end 14, and an inner surface 16 that extends through the outer member 12 between the distal end 13 and the proximal end 14.

The resiliently compressible polymeric foam from which the outer member 12 is formed should be easily compressible so that it can be compressed and inserted into the ear canal where it undergoes a substantial portion of its recovery, after which it should recover sufficiently to closely conform to the surface of the ear canal. The outer member 12 including its inner surface 16 can be molded and the mold surface, release agents and/or the material used may provide it with a smooth skin.

Alternatively, the outer member 12 except for its inner surface 16 can be molded, after which the inner surface 16 in the outer member 12 can be formed by a punching operation which forms the inner surface 16 extending through the outer member 12 between its opposite ends 13 and 14, with the inner surface 16 having a cross section of generally uniform shape and size along its axis. Suitable foam for the outer member 12 is a visco-elastic polyurethane commercially available from 3M Company, St. Paul, Minn., similar to the foam sold by 3M under the trademark ATTENUTECH. Another suitable foam would be the plasticized polyvinyl chloride foam commercially available from Aero, Indianapolis, Ind.

The sleeve 10 also includes an inner member 20 that has an axis 18, a distal end 22, a proximal end 23, an outer surface 24 that corresponds in shape to the inner surface 16 of the outer member 12, and an inner surface 28 defining a through passageway. In some embodiments, the inner member 20 can be adhesively secured to the outer member 12 using any suitable adhesive represented as adhesive layer 26. An exemplary adhesive includes CHEMLOCK 459 bonding adhesive available from Lord Corporation, Erie, Pa.

In some embodiments, the inner member 20 and the outer member 12 can be formed separately and then secured together. In other embodiments, the outer member 12 and the inner member 20 can be co-extruded. In particular embodiments, as illustrated, the inner member 20 can be an extruded tube formed of a relatively stiff but flexible polymeric material such as polyurethane.

The inner member 20 can be configured to provide longitudinal support to the foam outer member 12 to restrict changing the length of the foam outer member 12 when the sleeve 10 is engaged with the sound controlling structure 34. In some embodiments, the continuous generally annular portion 30 of the inner member 20 can firmly and frictionally engage over the outer surface 35 of the sound controlling structure 34 adjacent its distal end 36 when the sleeve 10 is engaged with the sound controlling structure 34. The axially extending portions 32 of the inner member 20 can easily flex radially away from the longitudinal axis of inner member 20 to conform to the outer surface 35 of the sound controlling structure 34.

In embodiments in which the sound controlling structure 34 includes abutment 38, the axially extending portions 32 can be sufficiently stiff so that their proximal ends engage the abutment 38 upon such engagement to help position the sleeve 10 along the outer surface 35 of the sound controlling structure 34.

The characteristics of the inner member 20, including the material from which it is made, the durometer of that material, the wall thickness of the inner member 20, and the number of axially extending portions 32 provided on the inner member 20, can be selected to provide a desired combination of those features for a given application. Suitable characteristics for the inner member materials include (but are not limited to) using elastomer (e.g., urethane) materials having Shore A readings in the range of about 40 to about 100 (preferably about 60 to about 80) with a wall thickness of from about 0.03 to about 1.0 mm (e.g., 0.75 mm). The number of axially extending portions 32 used can be in the range of 3 to 12. In some embodiments, the inner member 20 can include about 6 to 8 axially extending portions.

The outer surface 24 and the inner surface 28 of the inner member 20 can have cross sections of generally uniform shape and size along their axes, those surfaces 24 and 28 being generally cylindrical as illustrated. In other embodiments, the inner surface 16 of the foam outer member 12, the outer surface 24 and the inner surface 28 of the inner member 20 can have other profiles such as triangular, square, star shaped, or ribbed.

In some embodiments, the inner member 20 can have a continuous generally annular portion 30 adjacent its distal end 22, and a plurality of axially extending circumferentially spaced slits 37 between its inner and outer surfaces 28 and 24 and extending from its annular portion 30 to the proximal end 23 of the inner member 20. In some embodiments, the inner member 20 can include about 8 slits 37. The slits 37 define axially extending portions 32 of the inner member 20 that can flex radially outwardly of its axis, thus slightly stretching and/or compressing the foam of the outer member 12 along its inner surface 16.

In some embodiments, the inner surface 16 of the foam outer member 12 can have a cross section of generally uniform shape and size along its axis (generally cylindrical as illustrated) that corresponds in size and shape to the outer surface of the inner member 20 both when the foam outer member 12 is adhered to the inner member 20 and when the foam outer member 12 is fully expanded and its inner surface 16 is not attached to or compressed by any structure. Thus, adhering inner surface 16 of the foam outer member 12 to the inner member 20 will not cause any compressive or tensile stresses in the foam outer member 12 that, during storage of the sleeve 10 before it is used, could, under some conditions, lead to stress cracking or other failure of the foam outer member 12.

Figure 3:
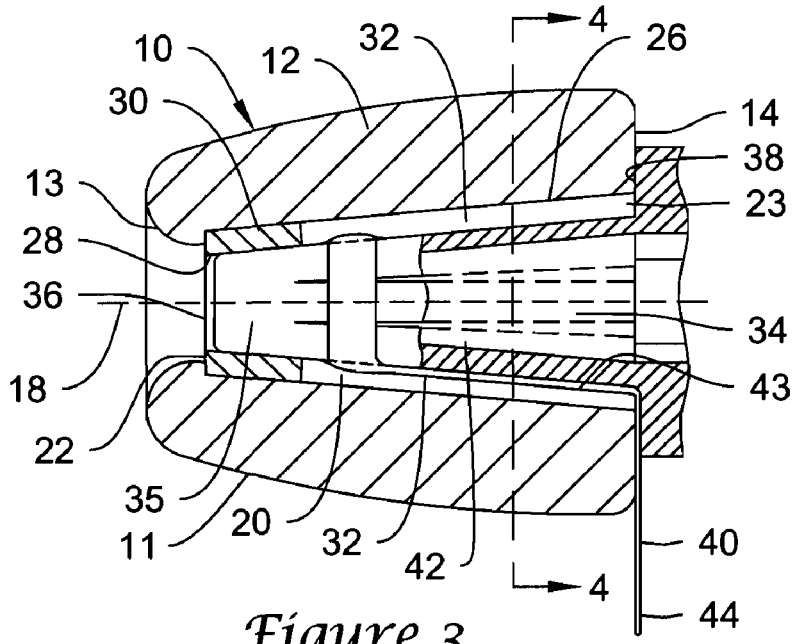
FIG. 3 is a longitudinal cross-sectional view of the sleeve of FIGS. 1 and 2 engaged on a sound controlling structure.
Figure 4:
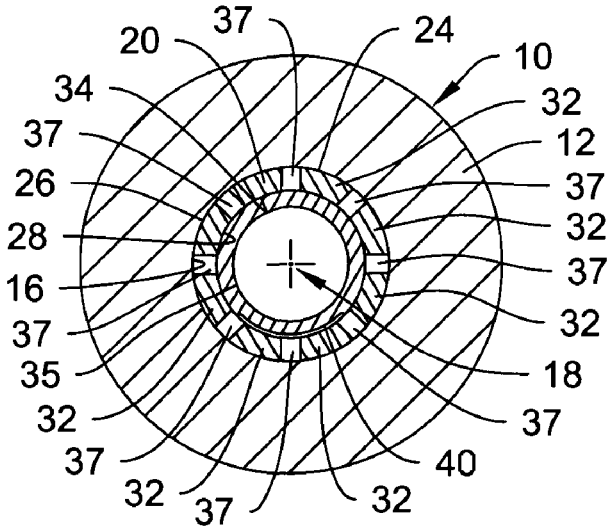
FIG. 4 is a cross-sectional view taken along line 4-4 of FIG. 3.

As is seen in FIGS. 3 and 4, the sleeve 10 is adapted for releasable attachment to an elongate sound controlling structure 34 having a non-constant radial profile. In the illustrated embodiment, the outer surface 35 diverges in cross-sectional size or area from a distal end 36 (i.e., a frusta conical outer surface, as illustrated). In other embodiments (described in greater detail hereinafter), the sound controlling structure 34 can have different non-constant radial profiles. In some embodiments, the sound controlling structure 34 can have an abutment 38 spaced a predetermined distance from its distal end 36.

The inner surface 28 of the inner member 20 is sized so that when the sound controlling structure 34 is engaged in the through passageway of the inner member 20 with the proximal end 23 of the inner member 20 adjacent the abutment 38, the continuous generally annular portion 30 of the inner member 20 can frictionally engage over the outer surface 35 of the sound controlling structure 34 adjacent its distal end 36, while the axially extending portions 32 of the inner member 20 will flex radially outwardly of the axis of the inner member 20 (see FIG. 4) to conform to the outer surface 35 of the sound controlling structure 34. Also, the proximal ends of the axially extending portions 32 that are at and generally aligned with the proximal end 23 of the inner member 20 will engage the abutment 38 to help properly position the sleeve 10 along the diverging outer surface 35 of the sound controlling structure 34.

Figure 5:
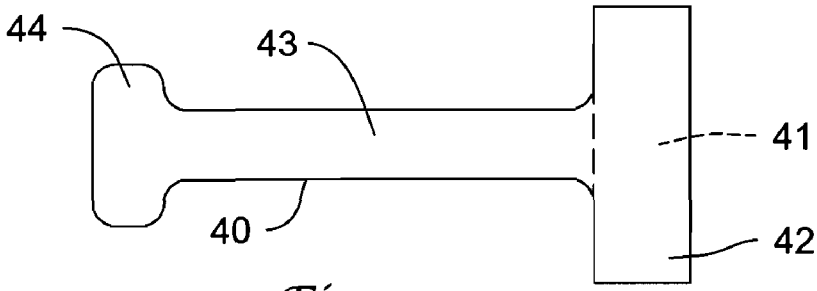
FIG. 5 is a plan view of a removal assisting tab that is attached to the sound controlling structure shown in FIGS. 3 and 4.

In some embodiments, a tab 40 can be provided to facilitate separating the sleeve 10 from the elongate sound controlling structure 34. The tab 40, shown attached to the sound control structure 34 in FIGS. 3 and 4, and shown separated from the sound control structure 34 in FIG. 5, can be a thin sheet of tough flexible material such as a 0.0063 inch or 0.016 mm thick sheet of polyester. The tab 40 can have a transverse base portion 42 having on one surface a layer 41 of pressure sensitive adhesive such as No. 8412 tape commercially available from 3M Company, St. Paul, Minn.

The base portion 42 of the tab 40 can be adapted to be wrapped around and adhered to the sound control structure 34 by that layer 41 of adhesive at a location spaced toward the abutment 38 from the portion of the control structure 34 that will be engaged by the annular portion 30 of the inner member 20. The tab 40 can have an elongate portion 43 that has no adhesive coating. The base portion 42 is adhered to the sound control structure 34 so that the elongate portion 43 extends from the base portion 42 axially along the sound control structure 34 and radially outwardly along the abutment 38 so that an enlarged end part 44 of the elongate portion 43 opposite the base portion 42 projects radially outwardly from the abutment 38.

When the sleeve 10 is engaged with the sound control structure 34, the base portion 42 and a major part of the elongate portion 43 will be positioned between the sleeve 10 and the sound control structure 34. Subsequent removal of the sleeve 10 from the sound control structure 34 can then be facilitated by grasping the end part 44 and pulling it toward the distal end 36 of the sound control structure 34 to pull part of the sleeve 10 over the tab 40 away from the outer surface of the sound control structure 34, thereby rupturing and/or stretching the sleeve 10 so that it can easily be removed from the sound control structure 34.

Instead of affixing the base portion 42 to the sound control structure 34 by wrapping it around and adhering it to the sound control structure 34 by the layer 41 of adhesive, the opposite ends of the base portion 42 can be bonded together (e.g., by heat sealing) to form a collar sized to frictionally engage the outer surface of the sound control structure 34, which frictional engagement may or may not be supplemented by a layer of adhesive on the inner surface of the collar.

Figure 6:
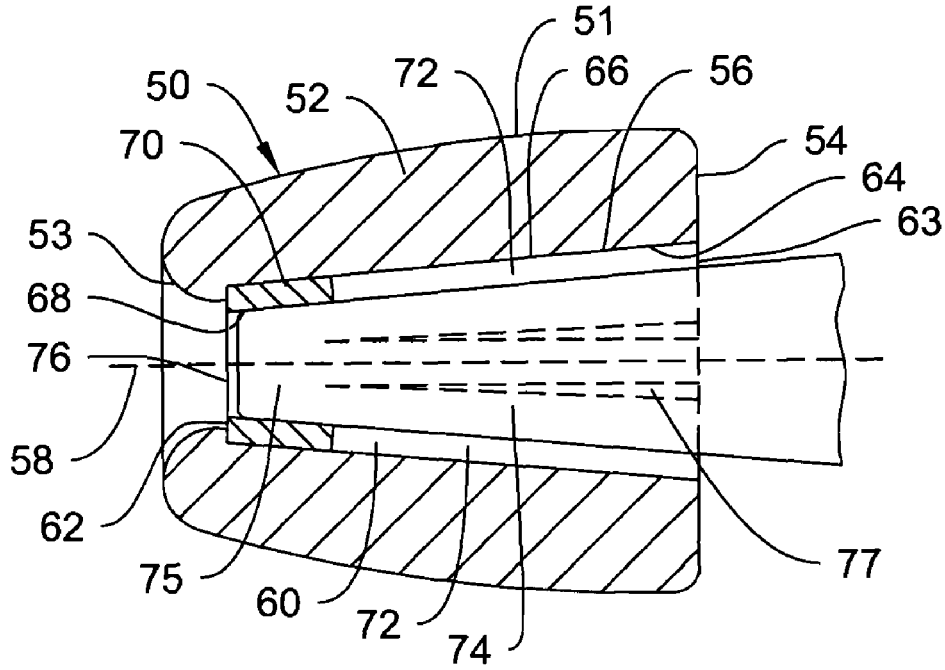
FIG. 6 is a longitudinal cross-sectional view of a sleeve in accordance with another embodiment of the invention.

Referring now to FIG. 6 of the drawings, there is illustrated a second embodiment of a sleeve 50. The sleeve 50 includes an outer member 52 of resiliently compressible polymeric foam having the same shape and characteristics as the sleeve 10 described above including an outer surface 51 adapted to conform to the inner surface of an ear after the foam outer member 52 is compressed, inserted into the ear canal, and allowed to expand. The outer member 52 includes a distal end 53 and a proximal end 54, and an inner surface 56 extending therebetween.

The sleeve 50 also includes an inner member 60 of a relatively stiff but flexible polymeric material such as a urethane. The inner member 60 has an axis 58, a distal end 62 and a proximal end 63, and an outer surface 64 corresponding in shape to and adhered to the inner surface 56 of the outer member 52 by a layer 66 of suitable adhesive such as previously discussed, and an inner surface 68 defining a through passageway. The outer and inner surfaces 64 and 68 of the inner member 60 can have cross sections of generally uniform shape and size along their axes, those surfaces 64 and 68 being generally cylindrical as illustrated.

The inner member 60 has a continuous generally annular portion 70 adjacent its distal end 62, and has a plurality of (i.e., 8 as illustrated) axially extending circumferentially spaced slits 77 between its inner and outer surfaces 68 and 64 and extending from its annular portion 70 to the proximal end 63 of the inner member 60. The slits 77 define axially extending portions 72 of the inner member 60 that can flex radially outwardly of its axis by slightly stretching and/or compressing the foam of the outer member 52 along its inner surface 56. The inner member 60 has essentially the same structure as the inner member 20 described above, including distal and proximal ends 62 and 63.

The inner surface 56 of the foam outer member 52 has an axis and has a cross section of generally uniform shape and size along its axis (generally cylindrical as illustrated) that corresponds in size and shape to the outer surface of the inner member 60 both when the foam outer member 52 is adhered to the inner member 60 and when the foam outer member 52 is fully expanded and its inner surface 56 is not attached to or compressed by any structure. Thus, adhering the foam outer member 52 to the inner member 60 will not cause any compressive or tension stresses in the foam outer member 52 that, during storage of the sleeve 50 before it is used, could, under some conditions, lead to stress cracking or other failure of the foam outer member 52.

As is seen in FIG. 6, the sleeve 50 is adapted for releasable attachment to an elongate sound controlling structure 74 having an outer surface 75 that diverges in cross-sectional size or area from a distal end 76 (i.e., a frusta conical outer surface, as illustrated). The inner surface 68 of the inner member 60 is sized so that when the sound controlling structure 74 is engaged in the through passageway of the inner member 60 with the distal end 62 of the inner member 60 adjacent the distal end 76 of the sound controlling structure 74, the continuous generally annular portion 70 of the inner member 60 will frictionally engage over the outer surface 75 of the sound controlling structure 74 adjacent its distal end 76, while the axially extending portions 72 of the inner member 60 will flex radially outwardly of the axis of the inner member 60 to conform to the outer surface 75 of the sound controlling structure 74. One or more of the parts of the axially extending portions 72 that project past the second end 54 of the outer portion 52 can be grasped and pulled on to help remove the sleeve 50 from the sound controlling structure 74.

Figure 7:
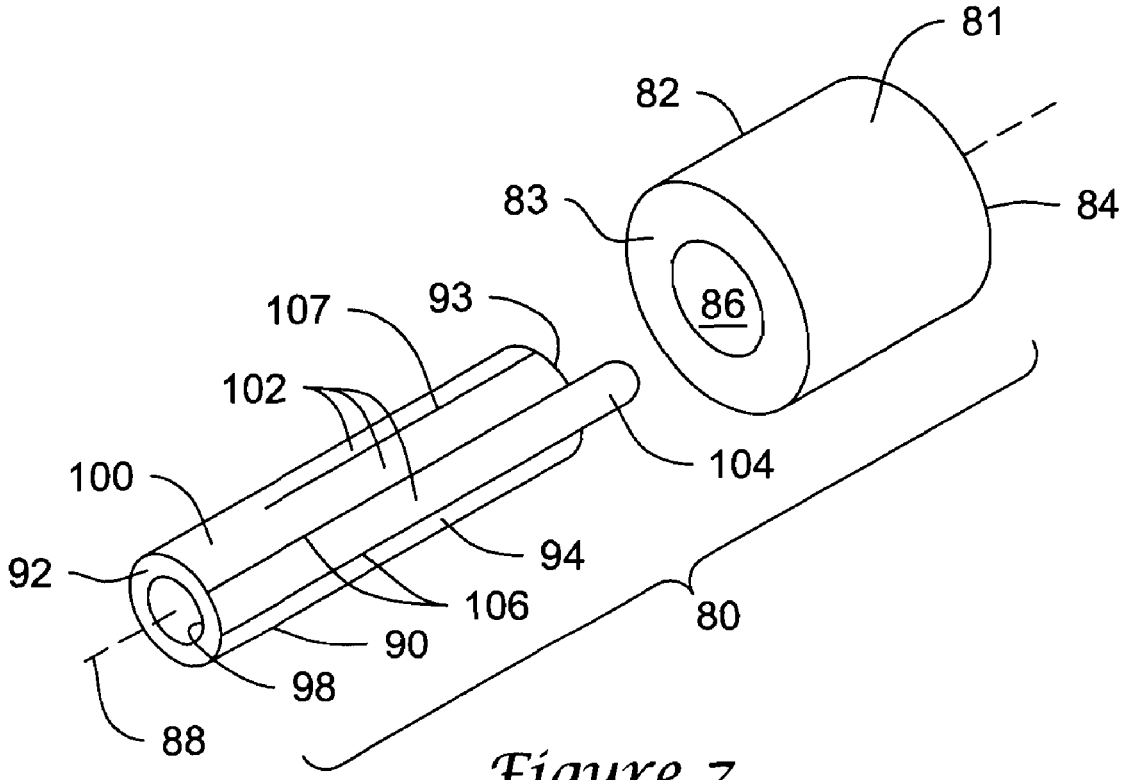
FIG. 7 is an exploded perspective view illustrating a foam outer portion and a tube for a sleeve in accordance with an embodiment of invention.

Referring now to FIG. 7, there is illustrated a third embodiment of a sleeve 80. The sleeve 80 includes an outer member 82 that has essentially the same shape and characteristics as the outer member 12 described above in that it is of resiliently compressible polymeric foam having an outer surface 81 adapted to conform to the inner surface of an ear after the foam outer member 82 is compressed, inserted into the ear canal, and allowed to expand. The outer member 82 has a distal end 83 and a proximal end 84 and an inner surface 86 extending therebetween.

The sleeve 80 also includes an inner member 90, such as a tubular member, that has been injection molded of a relatively stiff but flexible polymeric material such as SANTOPRENE™, which is commercially available from Advanced Elastomer Systems. The inner member 90 has an axis 88, a first or distal end 92, a second or proximal end 93 and an outer surface 94 corresponding in shape to and adhered to the inner surface 86 of the outer portion by a layer (not shown) of suitable adhesive (e.g., the CHEMLOCK 459 urethane bonding adhesive noted above), and an inner surface 98 defining a through passageway. The outer and inner surfaces 94 and 98 of the inner member 90 have cross sections of generally uniform shape and size along their axes, those surfaces 94 and 98 being generally cylindrical as illustrated.

The inner member 90 has a continuous generally annular portion 100 adjacent its first end 92, and has a plurality of (i.e., 8 as illustrated) axially extending circumferentially spaced slits 107 between its inner and outer surfaces 98 and 94 and extending from its annular portion 100 to the second end 93 of the inner member 90. The slits 107 define axially extending portions 102 of the inner member 90 that can flex radially outwardly of its axis by slightly stretching and/or compressing the foam of the outer portion 82 along its inner surface 86.

The inner surface 86 of the foam outer member 82 has an axis and has a cross section of generally uniform shape and size along its axis (generally cylindrical as illustrated) that corresponds in size and shape to the outer surface of the inner member 90 both when the foam outer member 82 is adhered to the inner member 90 and when the foam outer member 82 is fully expanded and its inner surface 86 is not attached to or compressed by any structure. Thus, adhering the foam outer member 82 to the inner member 90 will not cause any compressive or tensile stresses in the foam outer member 82 that, during storage of the sleeve 80 before it is used, could, under some conditions, lead to stress cracking or other failure of the foam outer member 82.

The sleeve 80 is adapted for releasable attachment to an elongate sound controlling structure having an outer surface that diverges in cross-sectional size or area from a distal end such as the sound controlling structure 74 with a frusta conical outer surface 75 illustrated in FIG. 6.

Optionally, as illustrated, a projection 104 can be provided at the end of at least one of the axially extending portions 102 to facilitate separating the sleeve 80 from an elongate sound controlling structure with which it is engaged. Removing the sleeve 80 from the sound control structure can be facilitated by grasping the projection 104 and pulling it toward the distal end of the sound control structure and distal end 92 of the inner member 90 to pull the sleeve 80 away from the outer surface of the sound control structure. If required for such removal, the axially extending portion 102 from which the projection 104 projects can be pulled to tear through the foam outer member 82, and the annular portion 100 of the inner member 90 can optionally be molded with score lines 106 (i.e., axially extending notches in the annular portion 100 that do not extend to its inner surface 98) aligned with the slits that form that axially extending portion 102 so that the annular portion 100 also can be ruptured by pulling on the projection 104.

In the embodiments shown thus far, the inner member 20 of FIGS. 1-4, the inner member 60 of FIG. 6, and the inner member 90 of FIG. 7 have each included a plurality of slits 37, 77, 107 that have been cut into the inner member 20, 60 and 90. However, the invention encompasses additional embodiments. FIGS. 8 through 14 illustrate additional inner members that can be used with a sound controlling device in accordance with the invention.

Figure 8:
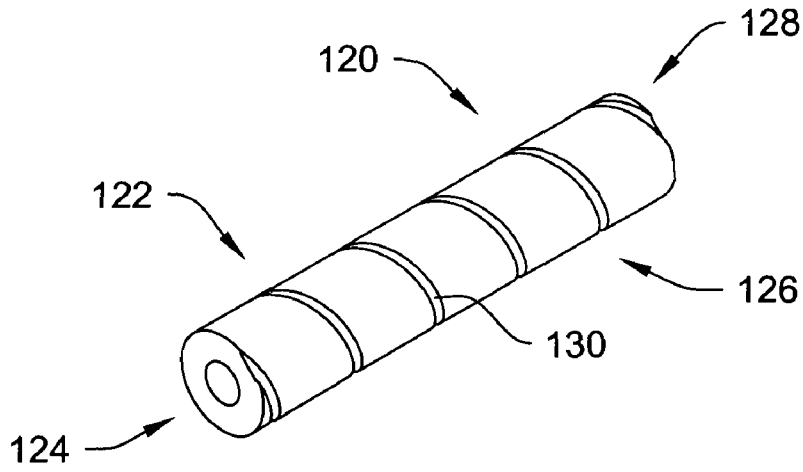
FIG. 8 is a perspective view of a spiral cut tube in accordance with an embodiment of the invention.

FIG. 8 shows an inner member 120 having a distal region 122, a distal end 124, a proximal region 126 and a proximal end 128. In some embodiments, a spiral cut 130 can extend from the distal region 122 to the proximal region 126. In particular embodiments, the spiral cut 130 can extend from the distal end 124 to the proximal end 128. Alternatively, the spiral cut can extend over only a portion of the length with the distal portion including an annular region as described in previous embodiments. As the inner member 120 is placed onto a sound controlling device such as a device including an elongate sound tube having a non-constant radial profile, the inner member 120 can expand radially as a result of the distal region 122 twisting with respect to the proximal region 126.

The inner member 120 can be biased into a non-expanded configuration such that the inner member 120 remains in contact with the sound controlling device upon which it is deployed. A foam outer member (such as outer member 12 illustrated in FIGS. 1-4) can also, in some embodiments, exert an inward force to counter the outward movement of portions of the inner member 120.

Figure 9:
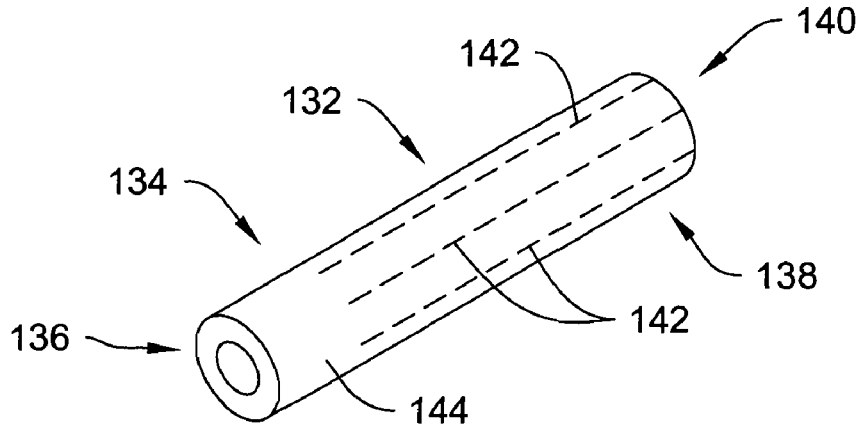
FIG. 9 is a perspective view of a perforated tube in accordance with an embodiment of the invention.
Figure 10:
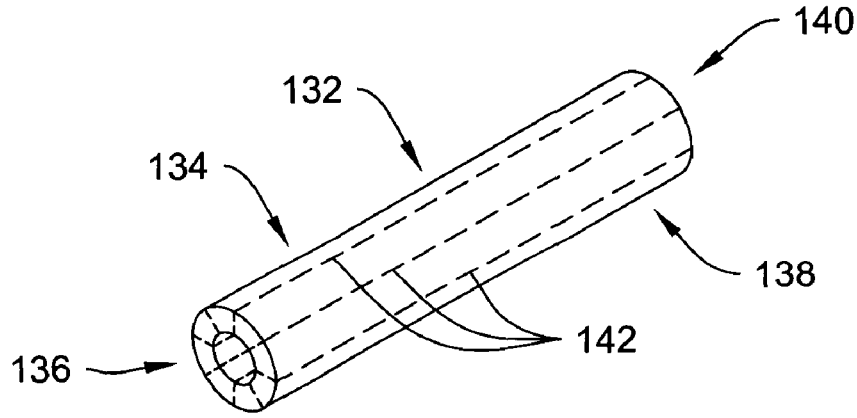
FIG. 10 is a perspective view of another perforated tube in accordance with an embodiment of the invention.

FIGS. 9 and 10 show an inner member 132 having a distal region 134, a distal end 136, a proximal region 138 and a proximal end 140. In the illustrated embodiment, the inner member 132 includes a plurality of preferential tear lines 142. In some embodiments, the preferential tear lines 142 can include perforations. As shown in FIG. 9, the tear lines 142 can extend from the distal region 134 to the proximal end 140 of the inner member 132, providing an annular section 144 that is free of tear lines 142 and that can frictionally engage the distal end of an elongate sound tube. In some embodiments, as illustrated in FIG. 10, the tear lines 142 can extend from the distal end 136 to the proximal end 140 of the inner member 132.

As the inner member 132 is placed onto a sound controlling device including an elongate sound tube having a non-constant radial profile, the inner member 132 can split or tear along the tear lines 142 as necessary to accommodate the profile of the elongate sound tube.

The inner member 132 can be biased into a non-expanded configuration such that the inner member 132 remains in contact with the sound controlling device upon which it is deployed. A foam outer member (such as outer member 12 illustrated in FIGS. 1-4) can also, in some embodiments, exert an inward force to counter the outward movement of portions of the inner member 132.

Figure 11:
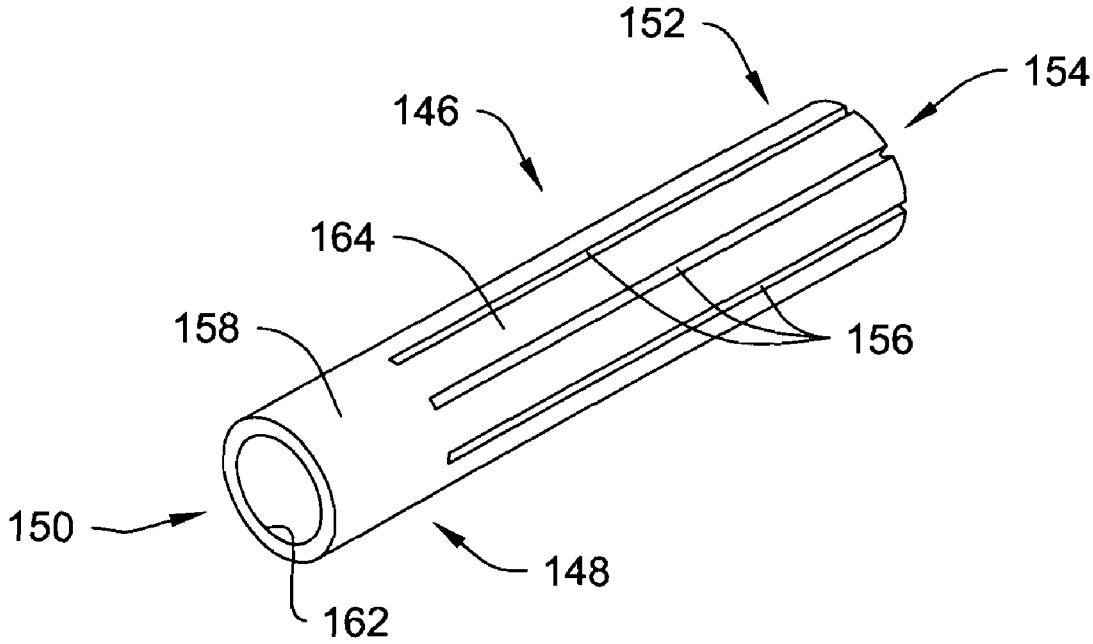
FIG. 11 is a perspective view of a grooved tube in accordance with an embodiment of the invention.
Figure 12:
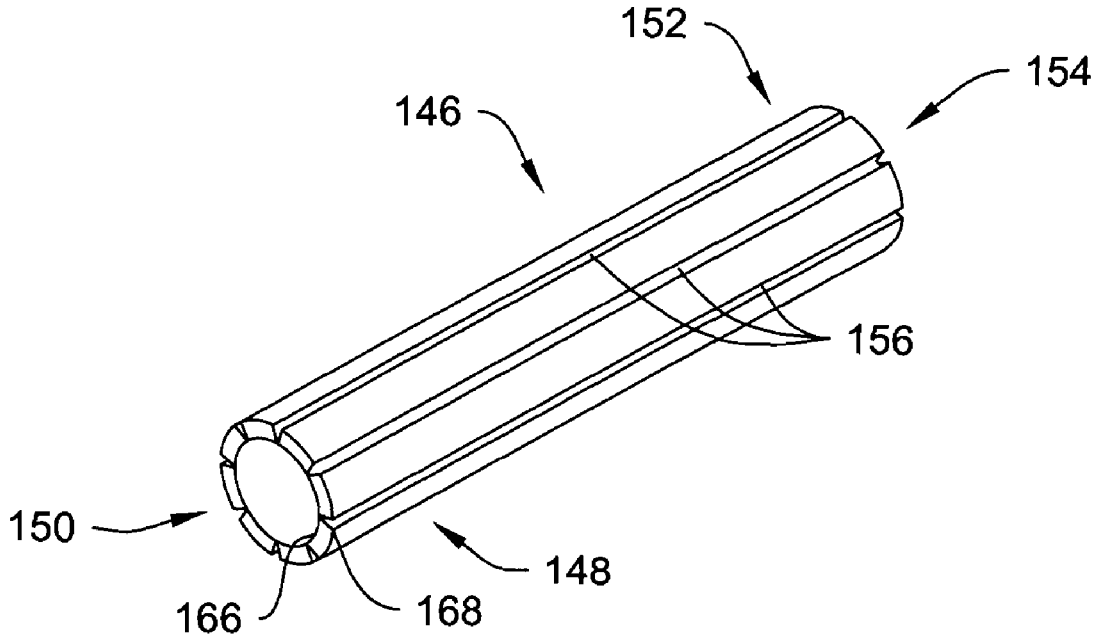
FIG. 12 is a perspective view of another grooved tube in accordance with an embodiment of the invention.

FIGS. 11 and 12 show an inner member 146 that has a distal region 148, a distal end 150, a proximal region 152 and a proximal end 154. The inner member 146 has an inner surface 162 and an outer surface 164. A plurality of grooves 156 extend from the distal region 148 to the proximal end 154 of the inner member 146, providing an annular section 158 that is free of grooves 156 and that can frictionally engage the distal end of an elongate sound tube. In some embodiments, as illustrated in FIG. 12, the grooves 156 can extend from the distal end 150 to the proximal end 154.

In some embodiments, as illustrated, the grooves 156 can have a V-shape and can extend outwardly from an apex 166 that is positioned at or near the inner surface 162 towards an outermost point 168 of the V-shape. In other embodiments, the grooves 156 can be configured such that the apex 166 is positioned at or near the outer surface 164.

As the inner member 146 is placed onto a sound controlling device including an elongate sound tube having a non-constant radial profile, the inner member 146 can split, tear or stretch along the grooves 156 as necessary to accommodate the profile of the elongate sound tube. The inner member 146 can be biased into a non-expanded configuration such that the inner member 146 remains in contact with the sound controlling device upon which it is deployed. A foam outer member (such as outer member 12 illustrated in FIGS. 1-4) can also, in some embodiments, exert an inward force to counter the outward movement of portions of the inner member 146.

Figure 13:
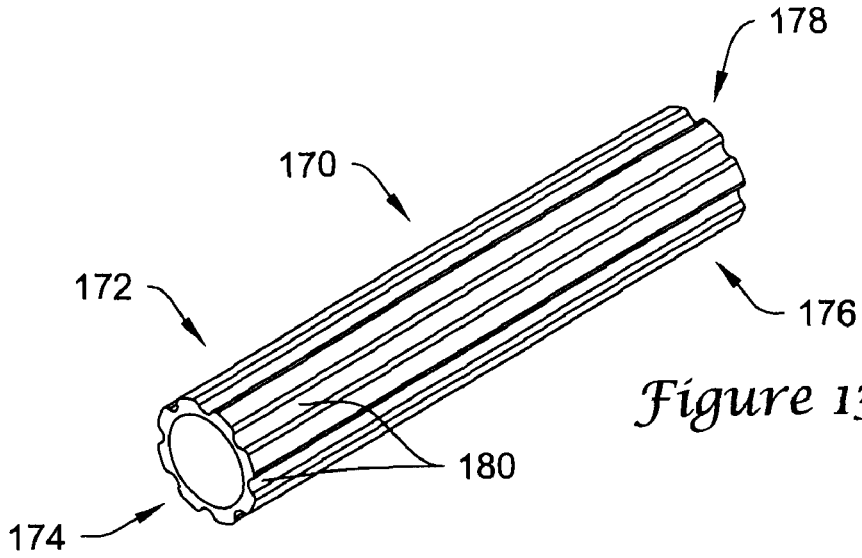
FIG. 13 is a perspective view of a fluted tube in accordance with an embodiment of the invention.

FIG. 13 shows a fluted inner member 170 that has a distal region 172, a distal end 174, a proximal region 176 and a proximal end 178. The fluted inner member 170 includes a plurality of axially aligned thinned portions 180 that can extend from the distal region 172 to the proximal region 176. In some embodiments, as illustrated, the thinned portions 180 can extend from the distal end 174 to the proximal end 178.

As the fluted inner member 170 is placed onto a sound controlling device such as a device having an elongate sound tube with a non-constant radial profile, the fluted inner member can stretch to accommodate diameter changes in the elongate sound tube. In some embodiments, the thinned portions 180 will preferentially stretch more than the rest of the fluted inner member 170.

The fluted inner member 170 can be biased into a non-expanded configuration such that the fluted inner member 170 remains in contact with the sound controlling device upon which it is deployed. A foam outer member (such as outer member 12 illustrated in FIGS. 1-4) can also, in some embodiments, exert an inward force to counter the outward movement of portions of the fluted inner member 170.

Figure 14:
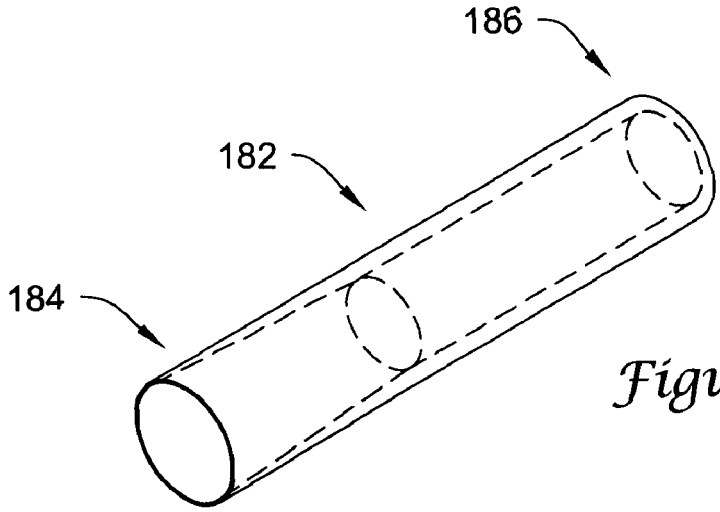
FIG. 14 is a perspective view of an internally tapered tube having a relatively more elastic portion in accordance with an embodiment of the invention.

FIG. 14 shows an alternative inner member 182 having a distal region 184 and a proximal region 186. In this embodiment, no grooves, tear lines or other cuts or indentations are necessary, as the inner member 182 includes a proximal region of tapering wall thickness. The thinner wall, due to material selection, allows the distal portion to radially expand in an elastic manner to conform to the sound control device.

The positioned elastic inner member 182 preferably remains biased toward a non-expanded configuration such that the more elastic portion of the inner member 182 remains in contact with the sound controlling device upon which it is deployed. A foam outer member (such as outer member 12 illustrated in FIGS. 1-4) can also, in some embodiments, exert an inward force to counter the outward movement of portions of the elastic inner member 182.

Figure 15:
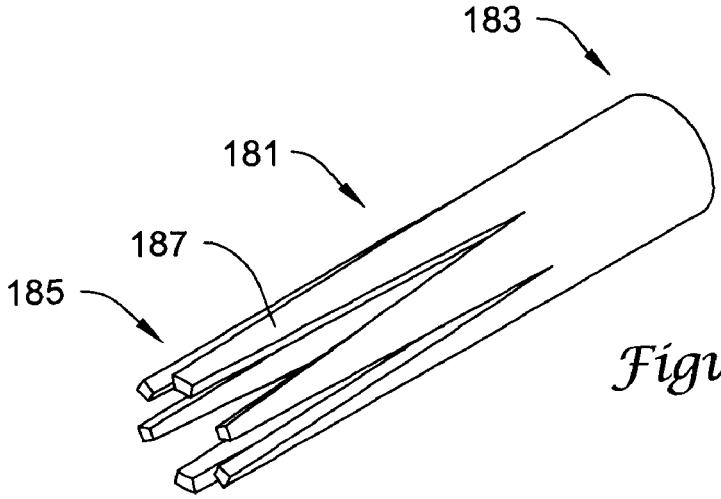
FIG. 15 is a perspective view of a tube including multiple longitudinal V-shaped projections in accordance with an embodiment of the invention.

FIG. 15 depicts another alternative inner member 181 having a generally annular distal region 183 and a proximal region 185 incorporating means for allowing radial expansion of that portion in response to engagement with the sound control device. The expandable portion includes multiple axially extending fingers 187 formed by cutting generally V-shaped longitudinal axial slits over a portion of the length of the inner member 181. The changing radial width of the fingers 187 provides for variation in flexibility from the proximal to the annular distal region.

The inner members 120, 132, 146, 170, 181 and 182 illustrated in FIGS. 8-15 can be used with an outer member 12 such as illustrated in FIGS. 1-7. The outer member 12 can be adhesively secured to the inner members 120, 132, 146, 170, 181 and 182 or, in some embodiments, the inner member 120, 132, 146, 170, 181 and 182 and the outer member 12 can be co-extruded, as discussed previously.

Figure 16:
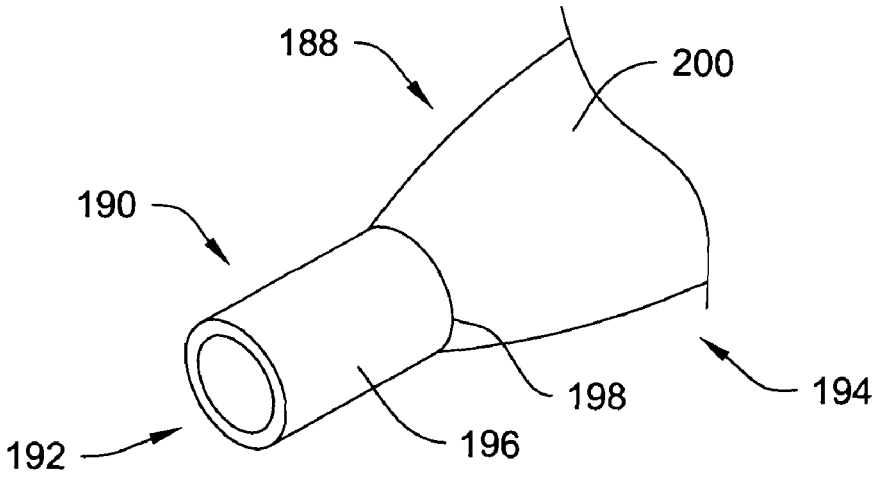
FIG. 16 is a perspective view of a portion of an elongate sound controlling device in accordance with an embodiment of the invention.
Figure 17:
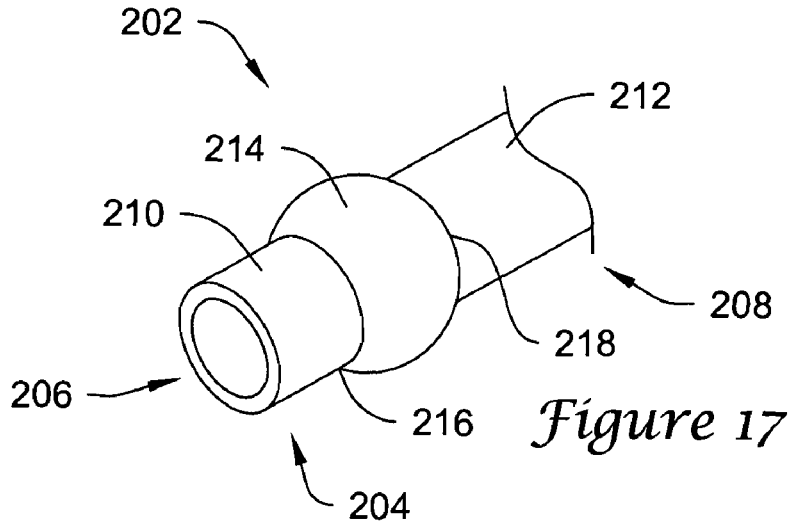
FIG. 17 is a perspective view of a portion of another elongate sound controlling device in accordance with an embodiment of the invention.
Figure 18:
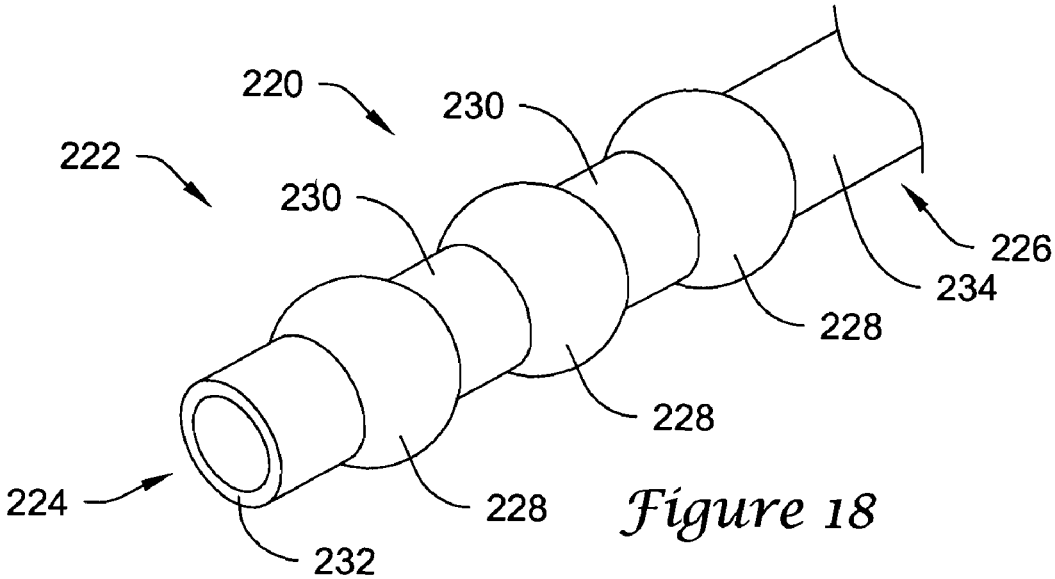
FIG. 18 is a perspective view of a portion of another elongate sound controlling device in accordance with an embodiment of the invention.

Once the inner member 120, 132, 146, 170, 181 and 182 and the outer member 12 have been assembled or formed into a user disposable sleeve, the sleeve can be employed on a variety of sound controlling devices. In some embodiments, the sleeve can be positioned over an elongate sound tube or other structure attached to or formed as a sound controlling device. The sleeve can be deployed over a sound controlling device having a frusta conical shape, such as the sound controlling device 34 having an outer surface 35, as illustrated, for example, in FIGS. 3 and 4. In other embodiments, the sleeve can be deployed over a sound controlling device having other geometries as well. FIGS. 16-18 illustrate portions of exemplary sound controlling devices over which the aforementioned sleeve can be deployed.

FIG. 16 illustrates a portion of a sound controlling device 188, which can include or be an elongate sound tube or other similar structure. The sound controlling device 188 has a distal region 190, a distal end 192 and a proximal region 194. In the illustrated embodiment, the sound controlling device 188 includes an annular portion 196 and a conical portion 200. The profile of the sound controlling device 188 changes from annular to conical at a transition point 198. In some embodiments, the transition point 198 can be a sharp change in profile, while in other embodiments, the transition between annular and conical can be more gradual.

FIG. 17 illustrates a portion of a sound controlling device 202 having a distal region 204, a distal end 206 and a proximal region 208. The sound controlling device 202 includes a distal annular portion 210 and a more proximal annular portion 212, separated by a bulbous portion 214. As illustrated, there are sharp transition points 216 and 218 between the bulbous portion 214 and the two annular portions 210 and 212. In other embodiments, the transitions can be more gradual.

FIG. 18 illustrates a portion of a sound controlling device 220 having a distal region 222, a distal end 224 and a proximal region 226. As illustrated, the sound controlling device 220 includes a total of three bulbous portions 228 separated by two annular portions 230. A distal annular portion 232 is located within the distal region 222 while a more proximal annular portion 234 extends proximally from the proximal-most bulbous portion 228. As discussed above with respect to FIG. 17, the transitions between annular and bulbous portions can be distinct or gradual.

WORKING EXAMPLE

As a non-limiting example, a sleeve 10 such as illustrated in FIGS. 1-4 was made for use on a sound controlling structure or probe tip 34 made by Etymotic Research, Inc., Elk Grove, Ill., for use on audio testing equipment such as the EROSCAN™ OAE test instrument. The probe tip 34 had a frusta conical surface with a diameter at its distal end 36 of about 0.125 inch (0.318 cm), a diameter at its abutment 38 of about 0.222 inch (0.564 cm), and an axial length between its distal end 36 and abutment of about 0.58 inch (1.47 cm). The probe tip 34 had two loud speakers and a microphone positioned at openings through its distal end 36. The sleeve 10 made for this probe tip 34 had an outer diameter for its foam outer member 12 of about 0.57 inch (1.54 cm), and a length between its ends 13 and 14 of about 0.6 inch (1.52 cm).

The foam used in the outer portion was the previously described visco-elastic polyurethane commercially available from 3M Company. The inner surface 16 of the outer member 12 and outer surface 24 of the inner member 20 were both cylindrical with diameters of about 0.2 inch (0.51 cm) and were adhered together with a layer 26 of the CHEMLOCK 459 bonding adhesive noted above. The inner member 20 had a cylindrical inner surface 28 that was about 0.12 inch (0.30 cm) in diameter, was made of urethane with a Shore A durometer of about 80, and had an axial length of about 0.6 inch (1.52 cm) between its ends 22 and 23, with the continuous generally annular portion 30 having an axial length of about 0.15 inch (0.38 cm). The inner member 20 had 8 axially extending portions 32 of about equal size.

It was found that the sleeve 10 could be repeatedly firmly engaged with the probe tip 34 with the first end 22 of the inner member 20 positioned at locations with respect to the distal end 36 of the probe tip 34 that varied in a range of only about 1 mm. Thus, for example, by appropriately adjusting the dimensions of the inner member 20 the sleeve 10 could be made so that the first end 22 of the inner member 20 could be repeatedly firmly engaged with the probe tip 34 with the first end of the inner member 20 spaced in a desired small range of locations with respect to the distal end 36 of the probe tip 34, such as projecting in the range of 2 to 3 millimeters past the distal end 36, spaced 2 to 3 millimeters along the probe tip 34 from the distal end 36, or aligned within 0.5 millimeter with the distal end 36.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A user disposable sleeve adapted for use with an elongate sound controlling device, the sleeve comprising:

an inner tubular member having a proximal region having a proximal end, a distal region having a distal end, an outer surface, and an inner surface defining a lumen extending from the proximal end of the inner tubular member to the distal end of the inner tubular member;

wherein the inner tubular member includes a plurality of grooves extending from the distal region of the inner tubular member to the proximal end of the inner tubular member;

wherein the plurality of grooves allow radial expansion of a portion of the inner tubular member in response to contact with a portion of the elongate sound controlling device; and an outer member having a first end, a second end, an inner surface extending between the first end of the outer member and the second end of the outer member, and an outer surface that is adapted to conform to the inner surface of an ear canal when the sleeve is disposed in the ear canal;

wherein the inner surface of the outer member is secured to the outer surface of the inner tubular member.

2. The sleeve of claim 1, wherein the plurality of grooves are located on the outer surface of the inner tubular member.

3. The sleeve of claim 1, wherein the plurality of grooves extend from the distal end of the inner tubular member to the proximal end of the inner tubular member.

4. The sleeve of claim 1, wherein the inner tubular member includes an annular section which is devoid of the plurality of grooves.

5. The sleeve of claim 1, wherein each of the plurality of grooves are V-shaped having an apex.

6. The sleeve of claim 5, wherein the apex is positioned near the inner surface of the inner tubular member.

7. The sleeve of claim 5, wherein the apex is positioned near the outer surface of the inner tubular member.

8. The sleeve of claim 1, wherein the inner tubular member is configured to stretch along the plurality of grooves to accommodate the profile of a portion of the elongate sound controlling device.

9. The sleeve of claim 1, wherein the inner tubular member is configured to split along the plurality of grooves to accommodate the profile of a portion of the elongate sound controlling device.

10. The sleeve of claim 1, wherein the inner tubular member is configured to tear along the plurality of grooves to accommodate the profile of a portion of the elongate sound controlling device.

11. A user disposable sleeve adapted for use with an elongate sound controlling device, the sleeve comprising:

an inner tubular member having means to allow radial expansion of a portion of the length of the inner tubular member in response to contact with a portion of the elongate sound controlling device to releasably secure the sleeve to the elongate sound controlling device; and an outer member secured to the inner tubular member, the outer member including a resilient foam material able to conform to contours of a user's ear canal;

wherein the inner tubular member includes a distal region having a distal end, a proximal region having a proximal end, an outer surface, and an inner surface;

wherein the means to allow radial expansion comprises a plurality of grooves extending from the distal region of the inner tubular member to the proximal end of the inner tubular member.

12. The sleeve of claim 11, wherein each of the plurality of grooves are V-shaped.

13. The sleeve of claim 11, wherein the plurality of grooves are located on the outer surface of the inner tubular member.

14. The sleeve of claim 11, wherein the plurality of grooves extend from the distal end of the inner tubular member to the proximal end of the inner tubular member.

15. The sleeve of claim 11, wherein the inner tubular member is configured to stretch along the plurality of grooves to accommodate the profile of a portion of the elongate sound controlling device.

16. The sleeve of claim 11, wherein the inner tubular member is configured to split along the plurality of grooves to accommodate the profile of a portion of the elongate sound controlling device.

17. The sleeve of claim 11, wherein the inner tubular member is configured to tear along the plurality of grooves to accommodate the profile of a portion of the elongate sound controlling device.

18. A user disposable sleeve adapted for detachable securement to a portion of an elongate sound controlling device, the sleeve comprising:

an inner tubular member formed of an elastomeric material, the inner tubular member having a proximal region having a proximal end, a distal region having a distal end, an outer surface, and an inner surface defining a lumen extending from the proximal end of the inner tubular member to the distal end of the inner tubular member;

wherein the inner tubular member includes a plurality of grooves longitudinally extending from the distal region of the inner tubular member to the proximal end of the inner tubular member;

wherein the plurality of grooves allow radial expansion of a portion of the inner tubular member in response to contact with a portion of the elongate sound controlling device; and an outer member formed of a resiliently compressible foam material, the outer member having a first end, a second end, an inner surface extending between the first end of the outer member and the second end of the outer member, and an outer surface that is adapted to conform to the inner surface of an ear canal when the sleeve is disposed in the ear canal;

wherein the inner surface of the outer member is secured to the outer surface of the inner tubular member.

19. The sleeve of claim 18, wherein each of the plurality of grooves are V-shaped.

20. The sleeve of claim 18, wherein the plurality of grooves are located on the outer surface of the inner tubular member.

21. The sleeve of claim 18, wherein the plurality of grooves extend from the distal end of the inner tubular member to the proximal end of the inner tubular member.

22. The sleeve of claim 18, wherein the inner tubular member is configured to stretch along the plurality of grooves to accommodate the profile of a portion of the elongate sound controlling device.

23. The sleeve of claim 18, wherein the inner tubular member is configured to split along the plurality of grooves to accommodate the profile of a portion of the elongate sound controlling device.

24. The sleeve of claim 18, wherein the inner tubular member is configured to tear along the plurality of grooves to accommodate the profile of a portion of the elongate sound controlling device.

* * * * *